US005318399A

United States Patent [19]

Marom

[11] Patent Number: 5,318,399

[45] Date of Patent: Jun. 7, 1994

[54] METHOD AND APPARATUS FOR REMOVING TIES AND WRAPPERS FROM TEXTILE FIBER BALES

[75] Inventor: Abi Marom, Mönchengladbach, Fed. Rep. of Germany

[73] Assignee: Trützschler GmbH & Co. KG, Mönchengladbach, Fed. Rep. of Germany

[21] Appl. No.: 841,018

[22] Filed: Feb. 25, 1992

[51] Int. Cl.[5] ..... B65B 69/00

[52] U.S. Cl. ..... 414/412; 414/786

[58] Field of Search ..... 414/412, 786

[56] References Cited

U.S. PATENT DOCUMENTS

| | | | |
|---|---|---|---|
| 3,853,235 | 12/1974 | Lambert et al. | 414/412 |
| 3,889,442 | 6/1975 | Grahn et al. | 414/412 X |
| 4,838,751 | 6/1989 | Hanaya et al. | 414/412 |
| 4,929,141 | 5/1990 | Keesey et al. | 414/412 |
| 5,074,739 | 12/1991 | Takahashi et al. | 414/412 |

FOREIGN PATENT DOCUMENTS

| | | |
|---|---|---|
| 2539529 | 2/1981 | Fed. Rep. of Germany . |
| 3123136 | 12/1982 | Fed. Rep. of Germany . |
| 3504768 | 8/1985 | Fed. Rep. of Germany . |
| 3727364 | 3/1988 | Fed. Rep. of Germany . |
| 3731653 | 4/1989 | Fed. Rep. of Germany . |
| 3707966 | 1/1990 | Fed. Rep. of Germany . |
| 3919222 | 8/1991 | Fed. Rep. of Germany . |
| 9000498 | 1/1990 | PCT Int'l Appl. . |
| 2170093 | 7/1986 | United Kingdom . |

*Primary Examiner*—David A. Bucci

*Attorney, Agent, or Firm*—Spencer, Frank & Schneider

[57] ABSTRACT

A method of removing ties and a wrapper from a fiber bale being at least partially covered by the wrapper and surrounded by the ties tightened about the wrapper includes the steps of severing the ties; carrying the ties away from the bale and pulling the wrapper off the bale in several parts after the ties are carried away from the bale.

20 Claims, 7 Drawing Sheets

METHOD AND APPARATUS FOR REMOVING TIES AND WRAPPERS FROM TEXTILE FIBER BALES

BACKGROUND OF THE INVENTION

This invention relates to a method and an apparatus for removing ties (such as wire hoops or straps) and wrapper parts from textile fiber bales.

According to a known process, the entire wrapper and the previously severed bales ties are removed together from the bale. As the bale abuts a carrier element, the wrapper is grasped by the carrier element which is then lowered through a clearance between conveying devices and pulls the wrapper and the bale ties through the clearance, so that the wrapper and the ties remain in contact with one another. It is a disadvantage of this process that the wrapper ma be caught by corners or edges of the bale and thus the carrier element does not reliably grasp and fully remove the same from the bale. It is a further disadvantage that the relatively long and unwieldy bale ties may become entangled in the wrapper which may lead to jamming, causing operational disturbances in the automatic process.

SUMMARY OF THE INVENTION

It is an object of the invention to provide an improved method and apparatus of the above-outlined type from which the discussed disadvantages are eliminated and which, in particular, ensures a secure grasping and removal of the wrapper from the bale.

This object and others to become apparent as the specification progresses, are accomplished by the invention, according to which, briefly stated, the method of removing ties and a wrapper from a fiber bale being at least partially covered by the wrapper and surrounded by the ties tightened about the wrapper includes the steps of severing the ties; carrying the ties away from the bale and pulling the wrapper off the bale in several parts after the ties are carried away from the bale.

By virtue of the fact that the ties are removed first, the wrapper parts may be subsequently securely grasped and pulled off. As a result, the parts of a wrapper which have originally been composed of two or more sections or a wrapper which has been cut into two or more parts may be removed in an operationally reliable manner so that a disturbance-free automatic removal of the wrapper is ensured.

DESCRIPTION OF THE PREFERRED EMBODIMENTS

Turning to FIGS. 1*a*, 1*b*, 2*a* and 2*b*, there is shown therein a fiber bale 1, such as a cotton bale, situated on a conveyor belt 9 for advancement in direction A. The conveyor belt 9 circulates in directions F, G. The bale 1 has a two-part wrapper 2*a*, 2*b* pulled from opposite sides onto the bale to thus form opposite, cap-like covers. The wrapper may be of sack cloth or other fabric, such as a fiber-reinforced synthetic material. Between the wrapper parts 2*a* and 2*b* a circumferential band of wrapper surface of width a remains exposed on the four bale sides 1*a*, 1*b*, 1*c* and 1*d*. The bale is surrounded by a plurality of bale ties 3*a*, 3*b* and 3*c*, such as steel straps which are secured around the bale with a substantial tension. The wrapper parts 2a and 2b are situated between the bale ties 3a–3c, on the one hand and the surfaces of the fiber bale 1, on the other hand.

Figure 1A:
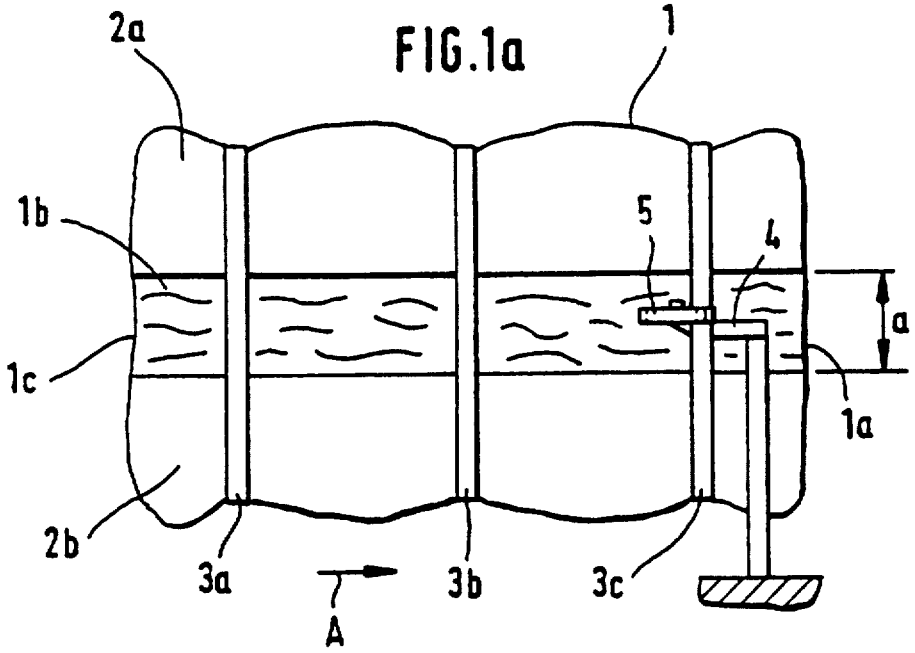
FIG. 1*a* is a schematic side elevational view of a tie severing device forming part of the apparatus according to the invention, shown while performing a tie severing operation.
Figure 1B:
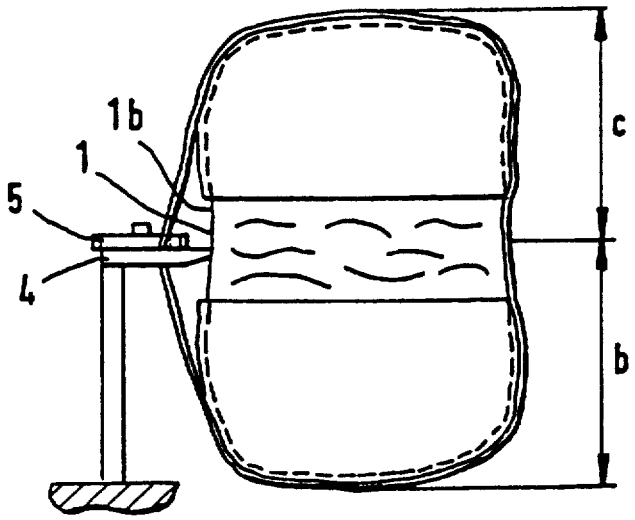
FIG. 1*b* is an end elevational view of the construction shown in FIG. 1*a*.
Figure 2A:
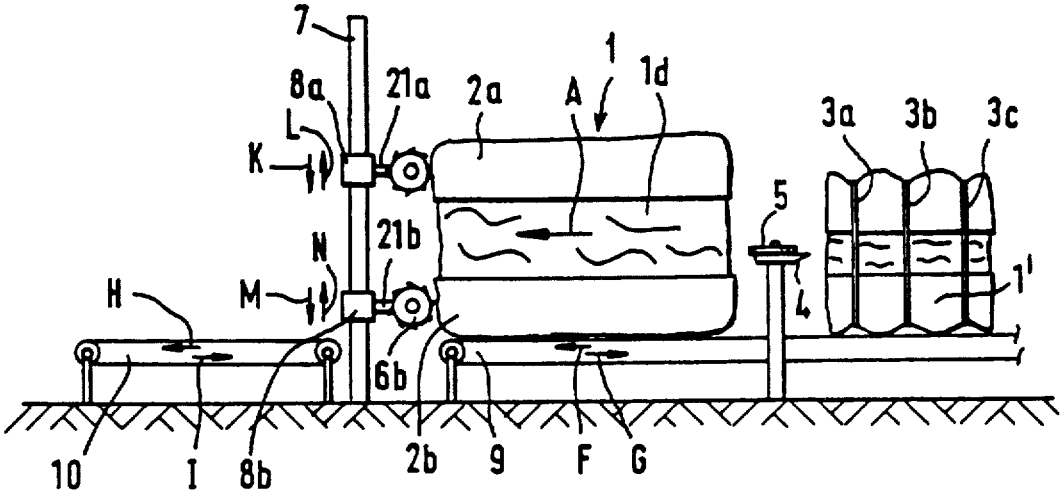
FIG. 2*a* is a schematic side elevational view of an apparatus according to the invention, including the components shown in FIGS. 1*a* and 1*d* and further including bale transporting devices.
Figure 2B:
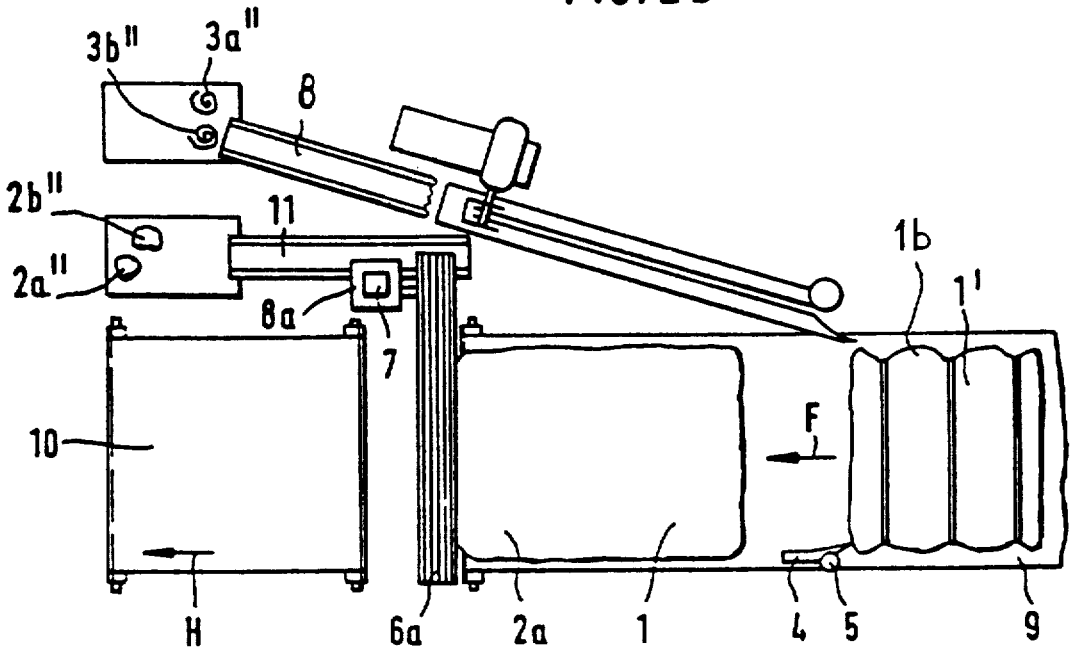
FIG. 2*b* is a schematic top plan view of the construction shown in FIG. 2*a*.
Figure 3A:
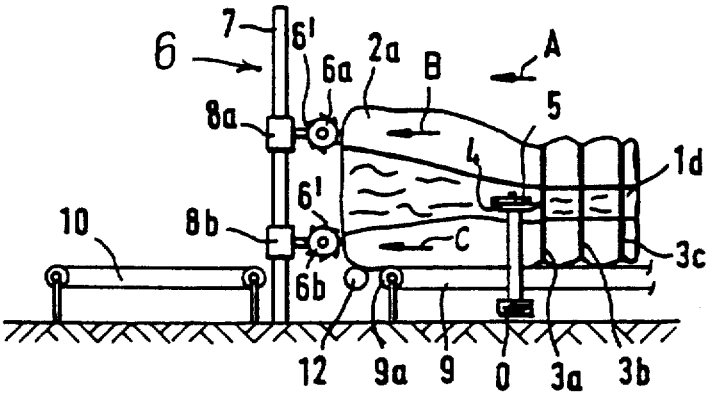
FIG. 3*a* is a schematic side elevational view similar to FIG. 2*a*, showing the apparatus during severance of the bale ties and simultaneous engagement by the wrapper removing device.

Adjacent a lateral, vertical surface 1b of the bale 1 there is arranged a tie severing device which includes a spike 4 extending at an oblique angle to the bale face 1b as shown in FIG. 2b. A slowly rotating severing disc 5 cooperates with the spike 4 to form a shearing device therewith. The tie severing device may be stationary (FIG. 2a) or may travel in the direction O (FIG. 3a). The severing mechanism 4, 5 is situated approximately in the middle of the side face 1b of the bale, that is, the distances b and c shown in FIG. 1b whose sum represents the height of the fiber bale, are approximately of identical length. Such a symmetrical arrangement results in an equalization of tensions as the spike 4 extends between a bale tie and a bale surface as also illustrated in FIG. 1b.

Figure 1C:
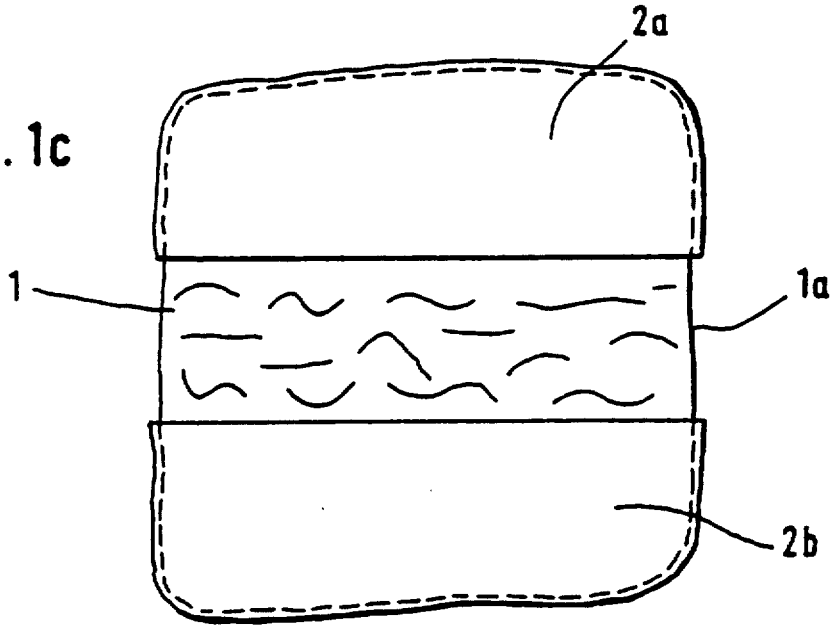
FIG. 1*c* is a side elevational view of a wrapped fiber bale with bale ties removed.
Figure 1D:
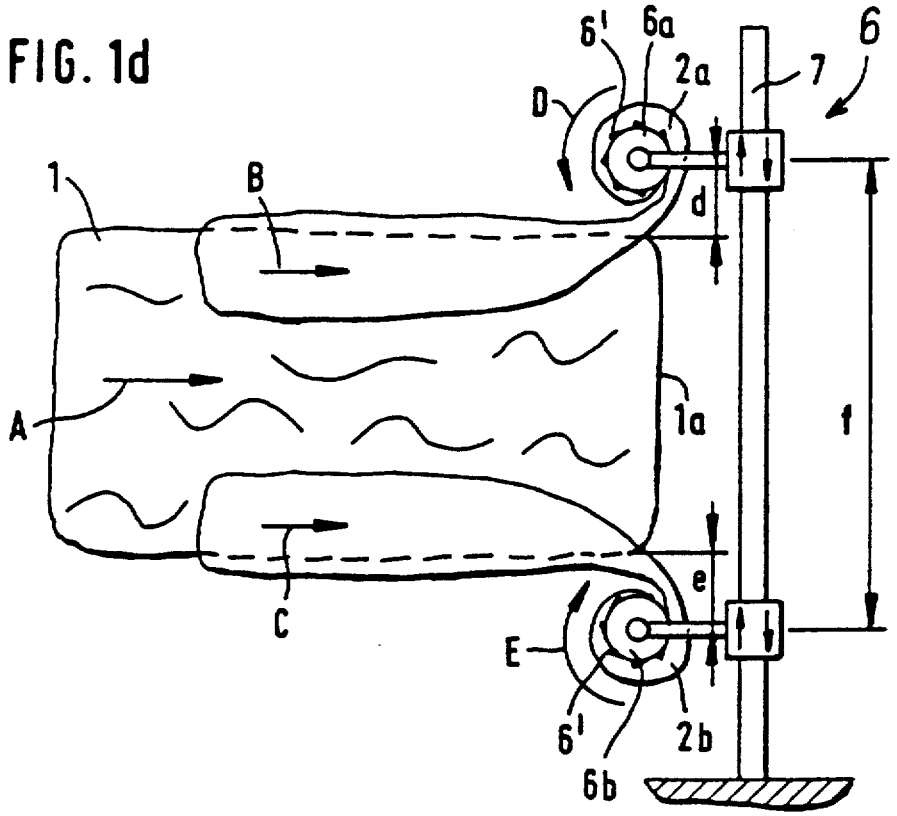
FIG. 1*d* is a schematic side elevational view of a wrapper removing device, forming part of the apparatus according to the invention, shown in the process of removing the wrapper from the fiber bale.

Also referring to FIG. 1d, adjacent the lateral face 1a of the fiber bale 1 a wrapper pull-off device 6 is arranged which has two horizontally supported, slowly rotatable pull-off rolls 6a and 6b spaced vertically from one another at a distance f. Each roll 6a and 6b, driven by a non-illustrated motor in directions D and E, has on its surface a plurality of grasping teeth 6'. The rolls 6a and 6b are oriented parallel to one another perpendicularly to the bale advancing direction A and are height-adjustable on a vertical stationary support post 7 in directions K, L, M and N (FIG. 2a).

In operation, the fiber bale 1 is advanced slowly by means of the conveyor belt 9 in the direction A past the stationary severing device 4, 5. The spike 4 of the severing device penetrates into the bale face 1b, passes consecutively under the bale ties 3a, 3b and 3c which, during such occurrence, are severed by the cutting disc 5 as the latter cooperates with the spike 4. The severed bale ties 3a–3c, upon severance, snap off the bale and are removed by means of a conveyor 8 shown in FIG. 2b, to be collected at 3a'', 3b'' for final disposal. The conveyor 8 extends from the tie severing device. As illustrated in FIG. 1c, the fiber bale is, in this operational phase, free from the bale ties, but still carries the wrapper parts 2a, 2b.

Thereafter, the fiber bale 1 is further conveyed by the belt 9 in the direction of the arrow A slowly past the wrapper pull-off device 6. The teeth 6' of the pull-off rolls 6a, 6b penetrate into the wrapper parts 2a and 2b and, as the rolls 6a, 6b are motor-driven to rotate about their axis, they wind the wrapper parts 2a, 2b about their cylindrical surface indicated by the arrows D and E, thus pulling the wrapper off the bale 1 in the direction of the arrows B and C.

Referring once more to FIG. 2a, the fiber bale 1 is shown after it has passed the severing device 4, 5. A fiber bale 1' trails the bale 1 and is depicted in a position just upstream of the severing device 4, 5. Downstream of the conveyor 9, as viewed in the bale advancing direction A, a further conveyor belt 10 is arranged for taking over conveyance of the fiber bale after the removal of the bale ties 3a–3c and the removal of the wrapper 2a, 2b. The conveyor 10 is circulated in directions H and I.

As shown in FIGS. 2a and 2b, laterally of the conveyor belt 10 the holding device (support post) 7 for the wrapper pull-off device 6 is positioned for supporting two vertically adjustable yoke elements 8a and 8b which carry the respective pull-off rolls 6a and 6b by means of webs 21a, 21b. The severing device 4, 5 extends over the conveyor belt 9. The removed wrapper parts 2a, 2b are moved out of the area of the apparatus on a further conveyor belt 11 to assume a position 2a'', 2b'' for final disposal.

Figure 3B:
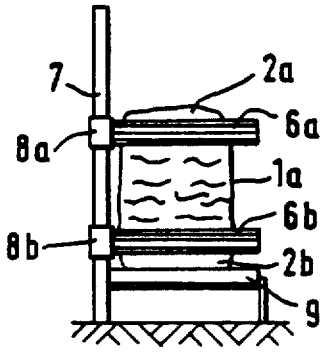
FIG. 3*b* is a schematic end elevational view of the construction shown in FIG. 3*a*.
Figure 3C:
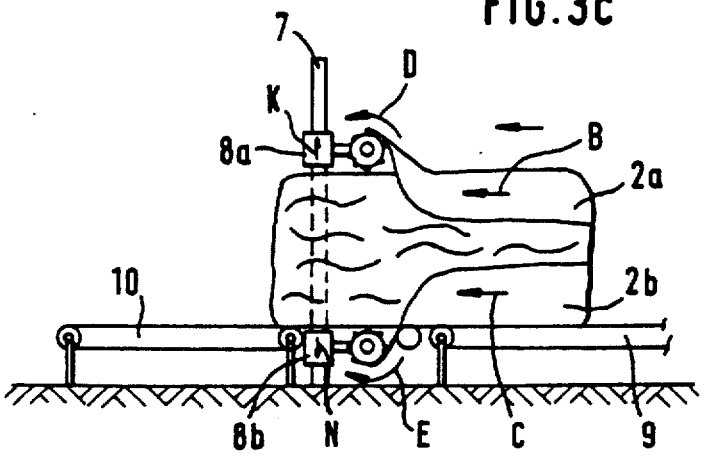
FIG. 3*c* is a schematic side elevational view of one part of the apparatus shown in FIG. 3*a*, depicted during removal of the wrapper from the bale.

FIG. 3a depicts an operational phase of the apparatus after the severing device 4, 5 has already removed some of the bale ties and the wrapper pull-off device 6 is in the process of removing the wrapper parts 2a, 2b in the direction B, C. As shown in FIG. 3b, the pull-off rolls 6a and 6b extend horizontally, at right angles to the conveying direction A over the entire width of the frontal face 1a of the bale 1. The bale 1 is moved by the belt 9 against the pull-off rolls 6a and 6b so that the teeth 6' thereof penetrate into the wrapper parts 2a, 2b. Thereafter, the pull-off rolls 6a and 6b are vertically moved upwardly and, respectively, downwardly on the post 7 from the position shown in FIG. 3b into the position shown in FIGS. 1d and 3c, whereby the pull-off rolls 6a and 6b pull the wrapper parts 2a and 2b upwardly and downwardly, respectively. As shown in FIG. 1d, in this operational phase the pull-off rolls 6a and 6b are at respective distances d and e from the bale surfaces. Such displacement of the rolls 6a and 6b provides sufficient space for winding the wrapper parts 2a, 2b on the respective rolls 6a and 6b. As shown in FIG. 3a, between the two conveyors 9 and 10 there is situated an intermediate supporting and guiding roll 12 for the bale and the wrapper part 2b. The roll 12 is oriented horizontally, parallel to the end roll 9a of the conveyor belt 9.

Figure 3D:
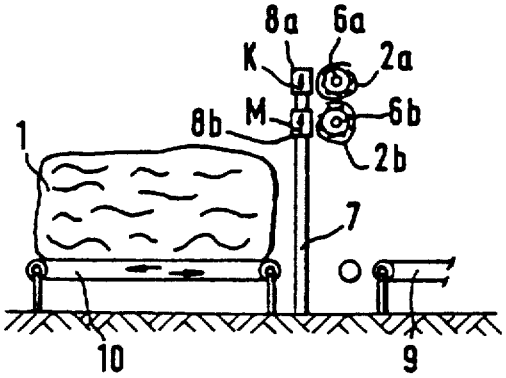
FIG. 3*d* is a view similar to FIG. 3*c*, illustrating the position of the fiber bale subsequent to the removal of the wrapper therefrom.
Figure 3E:
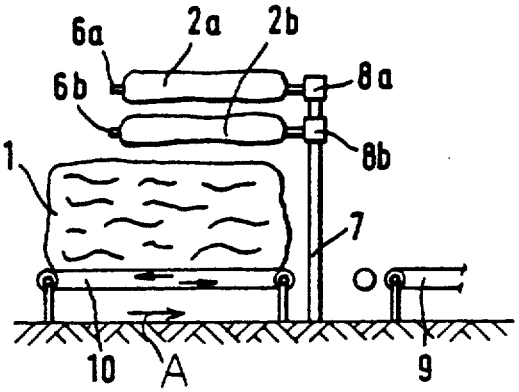
FIG. 3*e* is a view similar to FIG. 3*d*, showing the wrapper removing components in a different position.

After the wrapper parts 2a, 2b are fully removed from the bale 1 by the pull-off rolls 6a, 6b, the holder elements 8a and 8b are both moved upwardly, together with the wrapper parts 2a and 2b wound thereon, into the position illustrated in FIGS. 3d and 3e. Further, the pull-off rolls 6a, 6b may be swung 90° about the post 7 from their position shown in FIG. 3d into the their position illustrated in FIG. 3e where the roll axes are oriented parallel to the advancing direction A of the bale 1. In this position the wrapper parts 2a and 2b wound on the rolls 6a and 6b may be removed.

Figure 4A:
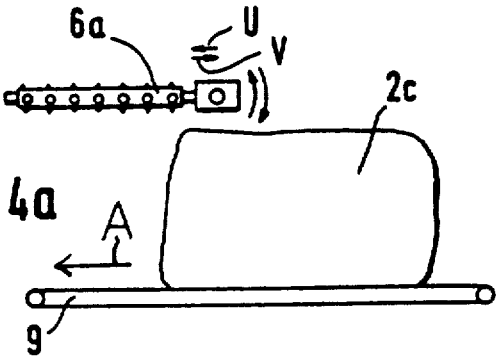
FIG. 4*a* is a schematic side elevational view of a wrapper removing device for laterally arranged partial wrappers, shown in an idle position.
Figure 4B:
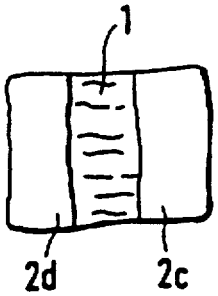
FIG. 4*b* is an end elevational view of the bale shown in FIG. 4*a*.
Figure 4C:
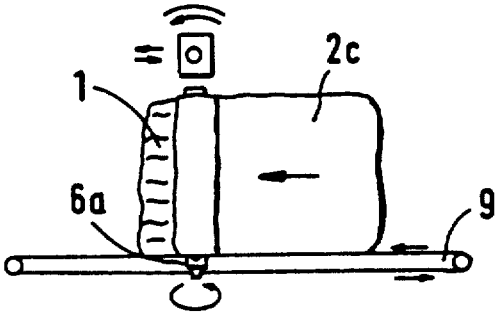
FIG. 4*c* is a schematic side elevational view similar to FIG. 4*a*, shown in an operational position.

According to a modification illustrated in FIGS. 4a and 4c, the pull-off rolls 6a and 6b (only the roll 6a is shown in FIGS. 4a and 4c) are situated bilaterally of the fiber bale and may be swung in a vertical plane into the operative position of FIG. 4c to remove wrappers 2d and 2c which, in contrast to the wrappers 2a and 2b, are positioned on two opposite ends (rather than on the top and on the bottom) of the fiber bale. The pull-off rolls may also be displaced parallel to the bale advancing direction as indicated by the arrows U and V.

In FIGS. 5, 6, 7a and 7b, structural details of the pull-off roll 6a are shown. The pull-off roll 6b may be identically constructed.

Figure 5:
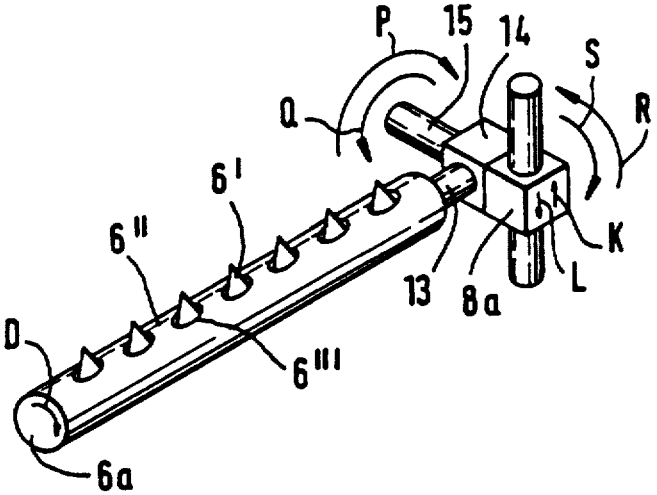
FIG. 5 is a schematic perspective view of details of the wrapper removing device shown in FIGS. 4*a* and 4*c*.
Figure 6:
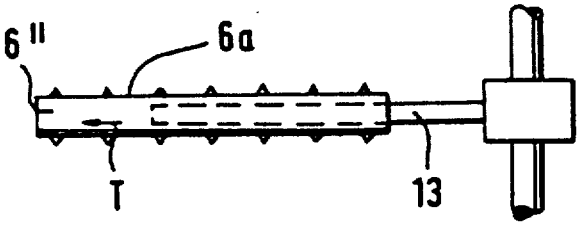
FIG. 6 is a schematic side elevational view of the structure shown in FIG. 5, illustrating further details.

Turning in particular to FIG. 5, the pull-off roll 6a is coaxially received on a shaft 13 which at one end is mounted in a rotary bearing 14. The latter, in turn, is held on a horizontal shaft 15 about which it may be rotated in either direction P or Q. The shaft 15 is secured to the holding element 8a which, as noted in connection with FIGS. 3d and 3e, may be rotated about the vertical post 7, as shown by the arrows R and S. As indicated in FIG. 6, the roll 6a may be axially pulled off the shaft 13 in the direction T to facilitate removal of the wound-up wrapper parts therefrom.

Figure 7A:
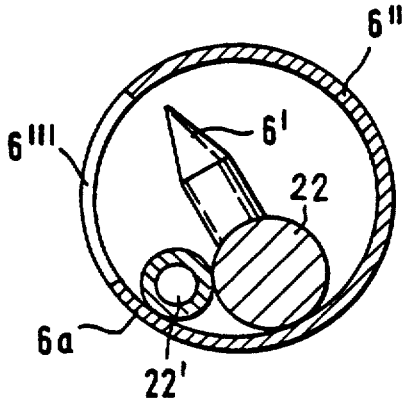
FIGS. 7*a* and 7*b* are cross-sectional views of two different operational positions of the wrapper removal roll shown in FIG. 5.
Figure 7B:
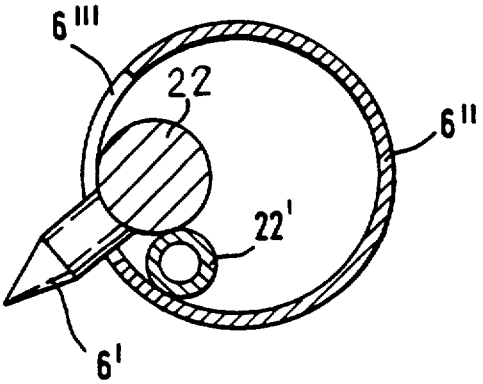

Turning in particular to FIGS. 7a and 7b, the roll 6a has a cylindrical shell 6'' which is provided with apertures 6''' through which the teeth 6' may project. The teeth 6' are movably arranged within the shell 6" to assume an inoperative, withdrawn position shown in FIG. 7a and an operative, extended position which is shown in FIG. 7b and in which the teeth 6' project from the shell 6" for grasping the wrapper parts and pulling them off the fiber bales. The mobility of the teeth 6' within the shell 6" is effected by providing a cylindrical bar 22 which extends within the shell 6" parallel to and spaced from the axis of the roll 6a. The teeth 6' are affixed to and extend from the bar 22. A further cylindrical bar 22' which extends parallel to the bar 22 is affixed to the inner face of the shell 6". Bar 22 may roll in a circular path on the cylindrical surface of the bar 22' and thus the teeth 6' may assume a withdrawn or an operative position as illustrated in FIGS. 7a and 7b. Thus, after the wrapper has been wound on the outside of the shell 6", the teeth 6' may be withdrawn into the position shown in FIG. 7a whereupon the wrapper parts may be readily axially slid off the shell 6".

Figure 8A:
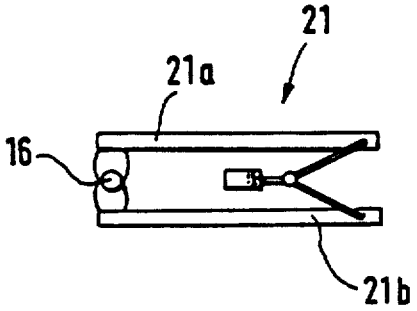
FIGS. 8*a* and 8*b* are schematic side elevational views in two different operative positions of another embodiment of the wrapper removing device according to the invention.
Figure 8B:
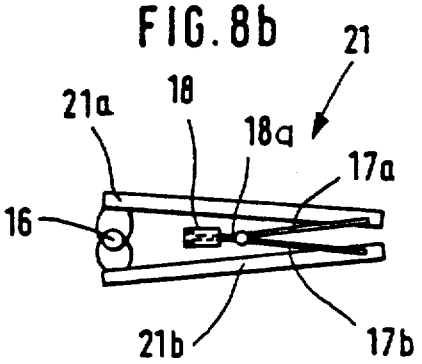

Turning to the embodiment illustrated in FIGS. 8a and 8b, there is shown a pull-off device 21 which has two movable surfaces 21a, 21b held at one end in a rotary bearing 16. The respective other ends of the surfaces 21a and 21b are, by means of guide linkages 17a and 17b, connected with the end of a piston rod 18a of a power cylinder 18 positioned between the surfaces 21a and 21b. FIG. 8a shows the position of the surfaces 21a and 21b during winding of the wrapper, while FIG. 8b shows the position of the surfaces 21a and 21b for removing the wound wrapper off the faces 21a and 21b.

Figure 9A:
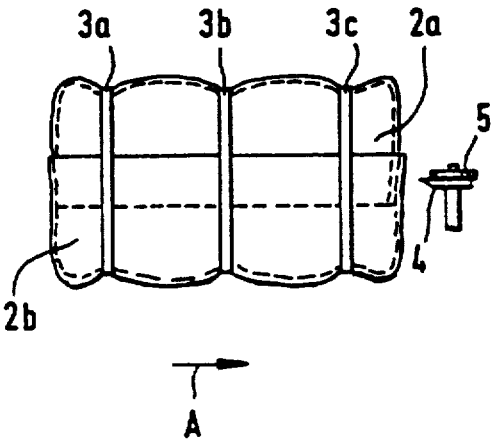
FIG. 9*a* is a schematic side elevational view of a bale tie removing device particularly for use with fully wrapped fiber bales.
Figure 9B:
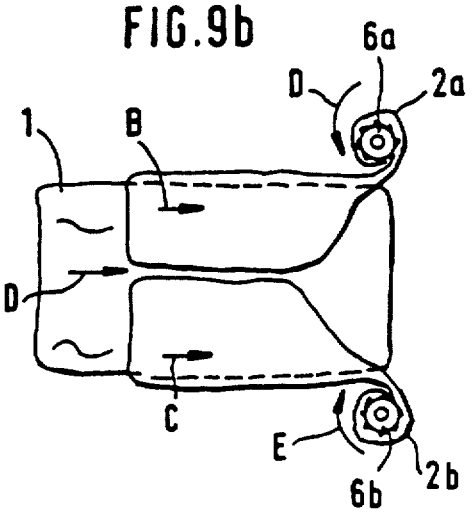
FIG. 9*b* is a schematic side elevational view of a wrapper removing device used in particular for removing wrappers of fully covered fiber bales.

FIGS. 9a and 9b show a packing which is used primarily for chemical fiber bales. The wrapper 2 fully covers the bale: the wrapper parts 2a and 2b are in an overlapping relationship. In operation, first the wrapper 2 and the bale ties 3a, 3b and 3c are cut by the severing device 4, 5 as it penetrates into the fiber bale. The bale ties 3a, 3b and 3c snap off the bale and are subsequently removed. Thereafter, the bale continues its motion in the advancing direction A and the wrapper parts 2a and 2b are separately removed from the bale and wound on the rolls 6a and 6b in a manner described in connection with FIGS. 1d, 2a, 2b and 3a-3e. Thus, in the arrangement shown in FIGS. 9a and 9b, the cutting of the wrapper and the severance of the tie bales are performed simultaneously, prior to the removal of the bale ties and wrapper.

Figure 10A:
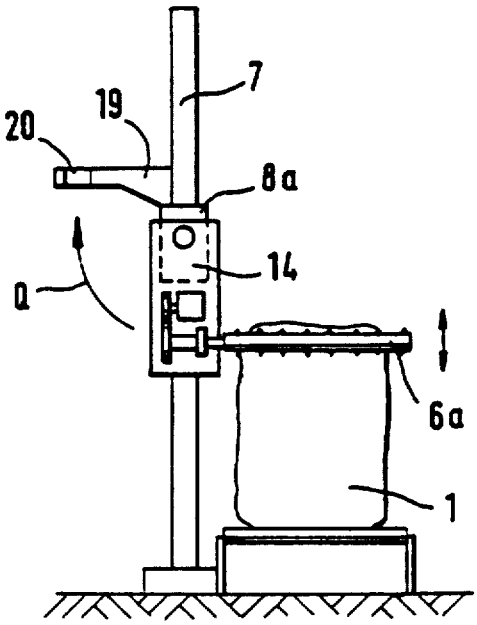
FIG. 10*a* is a schematic front elevational view of a further embodiment of the wrapper removing device according to the invention.
Figure 10B:
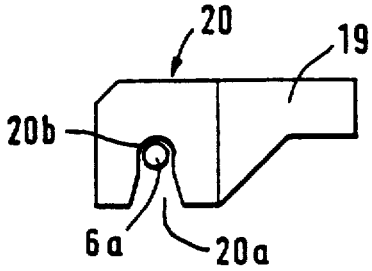
FIG. 10*b* is a schematic side elevational view of a detail of the construction illustrated in FIG. 10*a*.
Figure 10C:
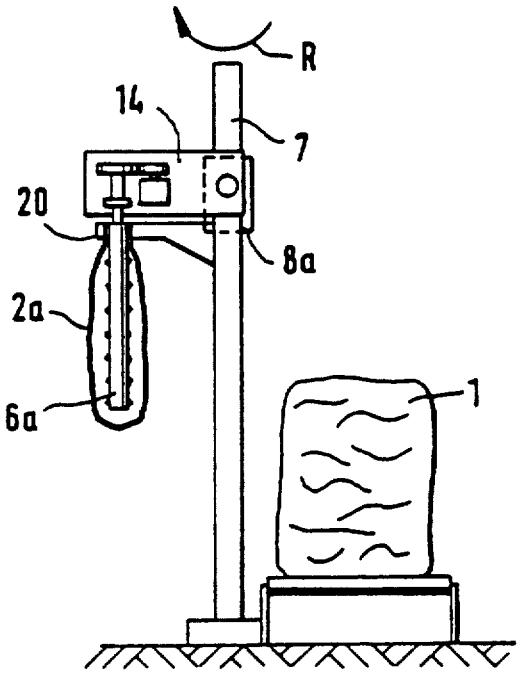
FIG. 10*c* is a schematic end elevational view similar to FIG. 10*a*, showing a different operational phase and position.
Figure 10D:
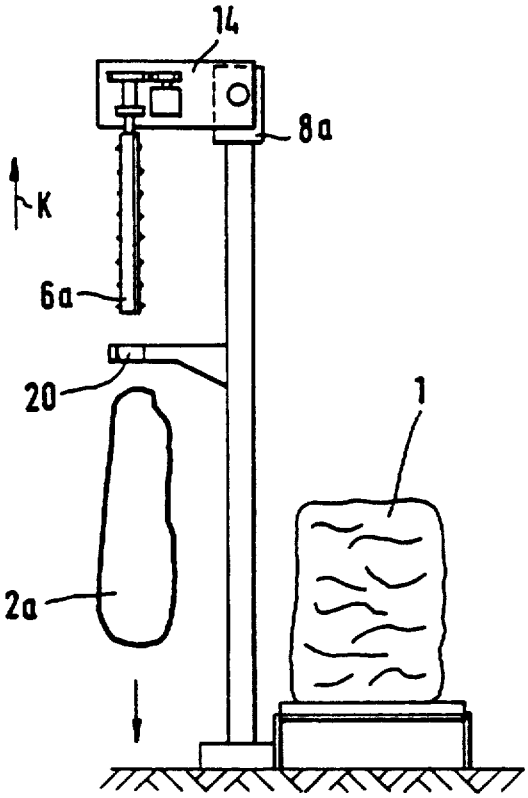
FIG. 10*d* is a schematic front elevational view of the embodiment shown in FIGS. 10*a* and 10*c*, illustrating yet another operational phase and position.

Turning to FIG. 10a, a stripping element 20 is held on the post 7 by a holder 19. The stripping element 20 has an opening 20a, which terminates in an inner, semicircular working edge 20b as shown in FIG. 10b. After the wrapper part (for example, 2a) has been wound on the roll 6a, the rotary bearing 14 is, together with the roll 6a, pivoted arcuately from a horizontal position shown in FIG. 10a in the direction of the arrow Q into a vertical position and thereafter the holding element 8a is, together with the roll 6a, moved upwardly. Then, as shown in FIG. 10c, the holding element 8a is swung in a horizontal plane about the vertical post 7 such that the stripper element 20 assumes a position between the wound-up wrapper 2a and the rotary bearing 14. In such a position the pull-off roll 6a has been introduced through the opening 20a to assume its position shown in FIG. 10b in which the stripper element 20 surrounds a substantial part of the circumference of the roll 6a. It is feasible to provide a semicircular element which closes off the opening 20a to thus circumferentially fully surround the roll 6a. Thereafter, the teeth 6' of the roll 6a are withdrawn as described in connection with FIGS. 7a and 7b and then the holding element 8a is shifted upwardly to assume a position shown in FIG. 10d. As a result of such a motion, the pull-off roll 6a is withdrawn upwardly from the stripper 20 whereupon the latter strips, by means of the edge 20b, the wound-up wrapper material which may drop off as shown in FIG. 10d.

It will be understood that the above description of the present invention is susceptible to various modifications, changes and adaptations, and the same are intended to be comprehended within the meaning and range of equivalents of the appended claims.

What is claimed is:

1. A method of removing ties and a multi-part wrapper from a fiber bale having a circumferential surface portion uncovered by the multi-part wrapper and being surrounded by the ties tightened about the wrapper, comprising the following steps:
   (a) severing the ties at the uncovered surface portion of the bale;
   (b) carrying the ties away from the bale after step (a); and
   (c) pulling the wrapper parts of the multi-part wrapper off the bale separately from one another after step (b).

2. A method as defined in claim 1, further comprising the step of advancing the bale during steps (a), (b) and (c).

3. A method as defined in claim 1, further comprising the step of winding pulled-off portions of the wrapper parts during step (c).

4. A method as defined in claim 3, further comprising the step of advancing the bale during the winding step.

5. A method as defined in claim 1, wherein the severing step comprises the step of severing the ties at about mid-height of the fiber bale.

6. An apparatus for removing ties and a wrapper from a fiber bale, comprising:
   (a) supporting means for positioning the fiber bale;
   (b) a severing device disposed at said supporting means for severing said ties;
   (c) a tie-removing device disposed at said supporting means for removing the severed ties from the bale; and
   (d) a pull-off device for removing the wrapper from the bale; said pull-off device including
      (1) a pull-off roll;
      (2) pull-off teeth carried on said pull-off roll;
      (3) means for rotating said pull-off roll; and
      (4) rotary bearing means for supporting said pull-off roll at one end thereof.

7. An apparatus as defined in claim 6, further comprising means for effecting a relative movement between the bale and the pull-off device.

8. An apparatus as defined in claim 6, further comprising a conveyor extending from said pull-off device for carrying the wrapper parts away from said pull-off device.

9. An apparatus as defined in claim 6, further comprising a conveyor extending from said severing device for carrying the severed ties away from said severing device.

10. An apparatus as defined in claim 6, wherein said pull-off roll is provided in a plurality; each pull-off roll removing a different wrapper part from said bale.

11. An apparatus as defined in claim 6, further comprising roll-supporting means for displaceably supporting said pull-off roll.

12. An apparatus as defined in claim 11, wherein said roll-supporting means includes means for permitting a vertical displacement of said pull-off roll.

13. An apparatus as defined in claim 6, wherein said supporting means comprises a conveyor for moving the bale in a direction of advance and further wherein said tie-removing device is situated upstream of said pull-off device as viewed in said direction of advance for removing the severed ties from the bale prior to the removal of the wrapper from the bale.

14. An apparatus for removing ties and a wrapper from a fiber bale, comprising (a) supporting means for positioning the fiber bale;

(b) a severing device disposed at said supporting means for severing said ties;

(c) a tie-removing device disposed at said supporting means for removing the severed ties from the bale; and (d) a pull-off device for removing the wrapper from the bale; said pull-off device including (1) a pull-off roll including (i) pull-off teeth carried on said pull-off roll;

(ii) a cylindrical shell provided with apertures constituting passages for said pull-off teeth; and (iii) tooth-moving means accommodated in said cylindrical shell for placing said pull-off teeth into a first position in which the pull-off teeth project through said apertures from said cylindrical shell and a second position in which said pull-off teeth are withdrawn into said cylindrical shell; and (2) means for rotating said pull-off roll.

15. An apparatus as defined in claim 14, further comprising a holding bar extending into said cylindrical shell coaxially therewith.

16. An apparatus as defined in claim 15, wherein said cylindrical shell is readily removable from said holding bar.

17. A method of removing ties and a wrapper from a fiber bale being at least partially covered by the wrapper and surrounded by the ties tightened about the wrapper, comprising the following steps:

(a) severing the ties;

(b) carrying the ties away from the bale after step (a); and (c) pulling the wrapper off the bale in several parts after step (b); said pulling step including the steps of causing two wrapper pull-off devices to penetrate the wrapper parts at a vertical end face of the bale, moving one of the pull-off devices vertically upwardly beyond a top face of the bale and moving the other of the pull-off devices vertically downwardly beyond a bottom face of the bale.

18. An apparatus for removing ties and a wrapper from a fiber bale, comprising (a) supporting means for positioning the fiber bale;

(b) a severing device disposed at said supporting means for severing said ties;

(c) a tie-removing device disposed at said supporting means for removing the severed ties from the bale; and (d) a pull-off device for removing the wrapper from the bale; said pull-off device including (1) a pull-off roll;

(2) pull-off teeth carried on said pull-off roll;

(3) means for rotating said pull-off roll; and (4) roll-supporting means for displaceably supporting sad pull-off roll; said roll-supporting means including bearing means for permitting a pivotal motion of said pull-off roll in a vertical plane.

19. An apparatus for removing ties and a wrapper from a fiber bale, comprising:

(a) supporting means for positioning the fiber bale;

(b) a severing device disposed at said supporting means for severing said ties;

(c) a tie-removing device disposed at said supporting means for removing the severed ties from the bale; and (d) a pull-off device for removing the wrapper from the bale; said pull-off device including (1) a pull-off roll;

(2) pull-off teeth carried on said pull-off roll;

(3) means for rotating said pull-off roll; and (4) roll-supporting means for displaceably supporting sad pull-off roll; said roll-supporting means including bearing means for permitting a pivotal motion of said pull-off roll in a horizontal plane.

20. An apparatus for removing ties and a wrapper from a fiber bale, comprising (a) supporting means for positioning the fiber bale;

(b) a severing device disposed at said supporting means for severing said ties;

(c) a tie-removing device disposed at said supporting means for removing the severed ties from the bale; and (d) a pull-off device for removing the wrapper from the bale; said pull-off device including (1) a pull-off roll;

(2) pull-off teeth carried on said pull-off roll; and (3) means for rotating said pull-off roll; and (e) stripping means for removing the wrapper from said pull-of roll would thereon.

* * * * *